United States Patent [19]

Higashi

[11] 4,445,487

[45] May 1, 1984

[54] EXHAUST GAS RECIRCULATION SYSTEM FOR AN INTERNAL COMBUSTION ENGINE

[75] Inventor: Katunori Higashi, Tokyo, Japan

[73] Assignee: Nissan Motor Company, Limited, Kanagawa, Japan

[21] Appl. No.: 367,222

[22] Filed: Apr. 9, 1982

[30] Foreign Application Priority Data

Apr. 11, 1981 [JP] Japan ..... 56-54727

[51] Int. Cl.[3] ..... F02M 25/06

[52] U.S. Cl. ..... 123/568

[58] Field of Search ..... 123/128

[56] References Cited

U.S. PATENT DOCUMENTS

| | | | |
|---|---|---|---|
| 1,673,181 | 6/1978 | Burtnett | 123/568 |
| 1,843,646 | 2/1932 | Moore | 123/568 |
| 3,294,073 | 12/1966 | Bressan | 123/568 |
| 4,018,198 | 4/1977 | Williams | 123/568 |
| 4,092,959 | 6/1978 | Mayer et al. | 123/568 |

*Primary Examiner*—Wendell E. Burns

*Attorney, Agent, or Firm*—Lowe, King, Price & Becker

[57] ABSTRACT

In an internal combustion engine having an intake passage provided therein with a throttle valve for controlling intake flow of air or an air-fuel mixture passing therethrough toward engine cylinders and an exhaust passage, an exhaust gas recirculation system comprises first means for conducting a portion of the exhaust gases from the exhaust passage into the intake passage downstream of the throttle valve and second means provided in the intake passage downstream of the throttle valve for preventing the exhaust gases fed through said first means from flowing upstream toward the throttle valve. Accordingly, the response accuracy of the throttle valve is protected from being impaired due to deposition of exhaust gas contaminants thereon.

17 Claims, 7 Drawing Figures

EXHAUST GAS RECIRCULATION SYSTEM FOR AN INTERNAL COMBUSTION ENGINE

BACKGROUND OF THE INVENTION

The present invention relates generally to an exhaust gas recirculation system for an internal combustion engine and, more specifically, to an improvement thereof which prevents exhaust gases, introduced into an intake passage downstream of a throttle valve, from flowing upstream toward the throttle valve and impairing its response accuracy by depositing exhaust gas contaminants thereon.

An exhaust gas recirculation system is well known in the art, wherein a portion of exhaust gases is reintroduced into an intake passage of an internal combustion engine from an exhaust passage thereof to recirculate the exhaust gases through the engine. FIG. 1 shows a conventional structure used in an exhaust gas recirculation system. An intake passage 1 extends from an air cleaner inlet to four engine cylinders, passing through a carburetor and an intake manifold 2, to introduce an air-fuel mixture to each engine cylinder. The intake manifold 2 has four branches 3 and a common riser 4 upstream of the juncture of the branches 3. The carburetor including a throttle valve for controlling the intake flow of the air-fuel mixture toward the engine cylinders is mounted on the upstream end surface 5 of the common riser 4 by way of a heat insulator. An exhaust gas recirculation (EGR) pipe 6 is perpendicularly inserted into the common riser 4 through an opening 7 formed in the wall of the riser 4 and its free ends opens into the intake passage 1. The other end of the EGR pipe 6 receives exhaust gases fed from an exhaust passage for recirculation of a portion of the exhaust gases into the intake passage.

FIG. 2 shows another conventional structure used in the exhaust gas recirculation system, wherein like or corresponding parts or members are designated by the same reference numerals as in FIG. 1. An EGR pipe 8 is perpendicularly inserted into the riser 4 through the opening 7 formed in the wall of the riser 4. The EGR pipe 8 crosses the intake passage 1 and fixedly engages at its one end with a recess 9 formed on the inner surface of the riser 4. The other end of the EGR pipe 8 receives the exhaust gases fed from the exhaust passage as in the foregoing conventional structure. The wall of the riser 4 is formed with four passages 10, each connecting the opening 7 or the recess 9 to one of four recesses 11 formed in the upstream end of the riser 4, as seen in FIG. 3. The EGR pipe 8 is formed with four apertures 12, each corresponding to one of the four passages 10 so that the exhaust gases fed from the exhaust passage is introduced into the intake passage 1 via the apertures 12, the passages 10 and the recesses 11. As in the structure of FIG. 1, the carburetor with the throttle valve is mounted to the upstream end surface 5 of the riser 4 by way of a heat insulator.

In the conventional structures of FIGS. 1 and 2, however, the exhaust gases are introduced into the intake passage 1 in a direction substantially perpendicular to the intake flow of the air-fuel mixture, or in a direction substantially against the intake flow. As a result, the exhaust gases flow upstream toward the throttle valve and impair its response characteristics by depositing exhaust gas contaminants thereon. In addition, in the structure of FIG. 2, forming the recesses 11 and the passages 10 complicates manufacture, and the heat insulator to be placed between the upstream end surface 5 of the riser 4 and the carburetor must be more heat-resistant than is required in the structure of FIG. 1, with the result that manufacturing costs increase.

SUMMARY OF THE INVENTION

Therefore, it is an object of the present invention to provide an exhaust gas recirculation system for an internal combustion engine which prevents exhaust gases, introduced into an intake passage downstream of a throttle valve, from flowing upstream toward the throttle valve and thereby impairing its response accuracy by depositing exhaust gas contaminants thereon.

According to the present invention, there is provided in an internal combustion engine having an intake passage provided therein with a throttle valve for controlling intake flow of air or an air-fuel mixture passing therethrough toward engine cylinders and an exhaust passage, an exhaust gas recirculation system comprising first means for conducting a portion of the exhaust gases from the exhaust passage into the intake passage downstream of the throttle valve and second means provided in the intake passage downstream of the throttle valve for preventing the exhaust gases fed through said first means from flowing upstream toward the throttle valve.

BRIEF DESCRIPTION OF THE DRAWINGS

The present invention will be more fully understood from the detailed description given below, and from the accompanying drawings of the preferred embodiment of the present invention, which, however, are not to be taken as limitative of the present invention in any way, but are for the purpose of elucidation and explanation only.

In the drawings.

DETAILED DESCRIPTION OF THE PREFERRED EMBODIMENTS

Figure 4:
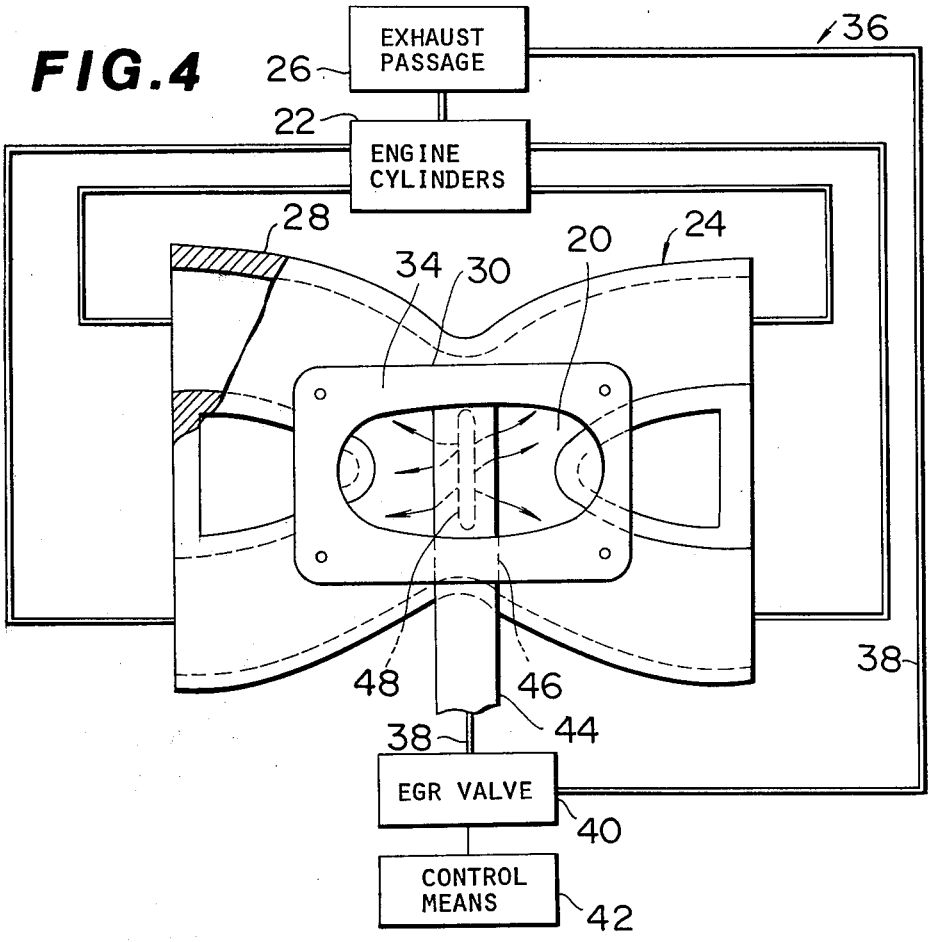
FIG. 4 is a schematic view of an exhaust gas recirculation system including a plan view of an improved portion thereof according to a preferred embodiment of the present invention.

Referring now to FIG. 4, there is illustrated a preferred embodiment of the present invention. An intake passage 20 extends from an air cleaner inlet (not shown) to four engine cylinders 22, passing through a carburetor (not shown) and an intake manifold generally designated by a reference numeral 24, for introducing an air-fuel mixture to each engine cylinder 22. An exhaust passage 26 passes therethrough exhaust gases discharged from the engine cylinders toward a tail pipe (not shown) to be exhausted therefrom. The intake manifold 24 has four branches 28 and a common riser 30 upstream of the juncture of the branches 28. The carburetor including a throttle valve (not shown) for controlling the intake flow of the air-fuel mixture toward the engine cylinders 22 is mounted on the upstream end surface 34 of the common riser 30 via a heat insulator (not shown).

An exhaust gas recirculation system generally designated by a reference numeral 36 comprises an exhaust gas recirculation (EGR) passage 38 providing communication between the exhaust passage 26 and the intake passage 20 for recirculation of a portion of the exhaust gases into the intake passage 20, an EGR valve 40 provided in the EGR passage 38 for controlling the recirculation rate of the exhaust gases into the intake passage 20 and control means 42 for actuating the EGR valve 40 depending upon engine conditions. Since the construction and operation of the EGR valve 40 and the control means 42 is well known in the art, further detailed description thereof will not be provided in order to avoid prolixity of description.

The EGR passage 38 is defined downstream of the EGR valve 40 by an EGR pipe 44. The EGR pipe 44 has a circular or an oval cross-section and is perpendicularly inserted into the riser 30 through an opening 46 formed in the wall of the riser 30. The EGR pipe 44 crosses the intake passage 20 and is fixedly engaged at its one end with the inner surface of the riser 30 opposite the opening 46. The EGR pipe 44 is formed at the side thereof downstream of the intake flow of the air-fuel mixture with an aperture 48 extending in the longitudinal direction of the EGR pipe 44, so that the EGR passage 38 communicates with the intake passage 20 at the side of the EGR pipe 44 downstream of the intake flow of the air-fuel mixture to introduce the exhaust gases into the intake passage in a direction substantially along the direction of the intake flow of the air-fuel mixture.

Accordingly, the exhaust gases introduced into the intake passage are prevented from flowing upstream toward the throttle valve and impairing its response accuracy by depositing exhaust gas contaminants thereon.

Figure 1:
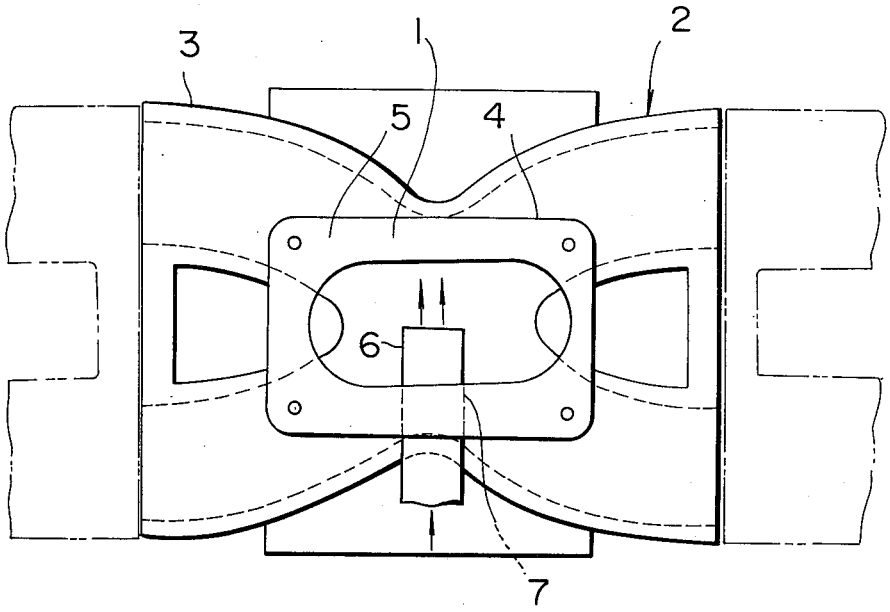
FIG.1 PRIOR ART
FIG. 1 is a plan view of a conventional structure for an exhaust gas recirculation system.
Figure 2:
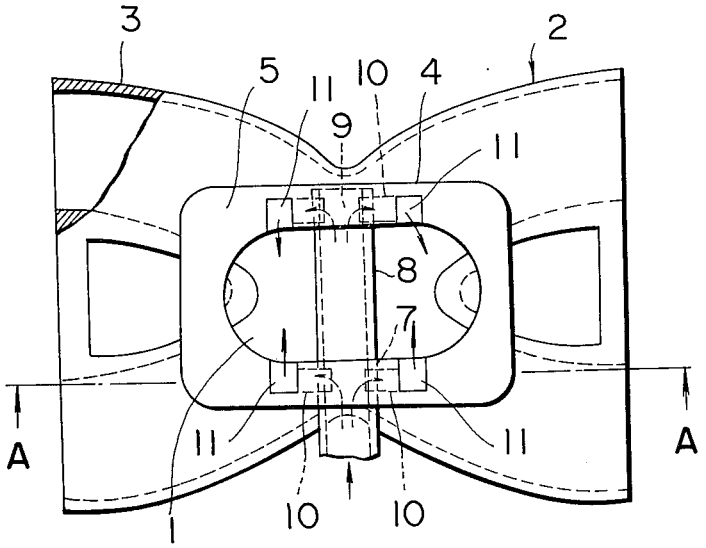
FIG.2 PRIOR ART
FIG. 2 is a plan view of another conventional structure for an exhaust gas recirculation system.
Figure 3:
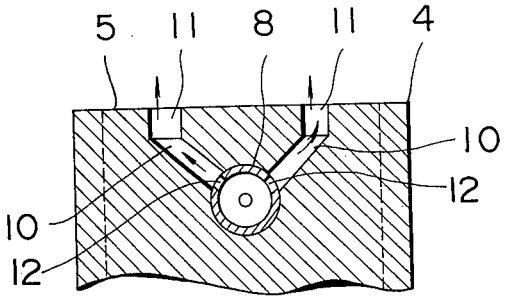
FIG.3 PRIOR ART
FIG. 3 is a cross-sectional view taken along line A—A in FIG. 2.

It is also the advantage of the present structure that since the EGR passage 38 communicates with the intake passage 20 at the side of the EGR pipe 44 downstream of the intake flow of the air-fuel mixture, the exhaust gases are introduced into the intake passage 20 at a position farther away from the throttle valve compared with the conventional structures of FIGS. 1 and 2 if the EGR pipes 6, 8 and 44 are placed in the same relationship to the throttle valve.

In addition, the present structure prevents the intake air-fuel mixture from entering the EGR pipe 44, so that occurrence of accumulation of the fuel or water within the EGR pipe 44 can be avoided.

Furthermore, although producing highly advantageous effects as mentioned above, the present structure is very simple and preserves manufacturing economy.

Figure 5:
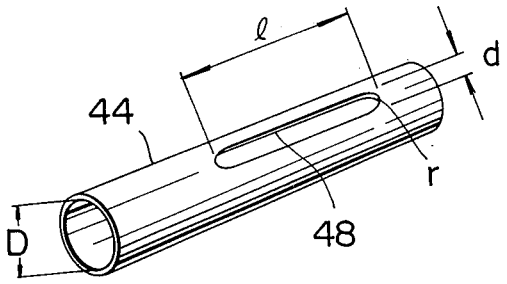
FIG. 5 is a perspective view of an EGR pipe to be used in the preferred embodiment of the present invention.

Exemplary sizes of various features of the EGR pipe 44 will be specified hereinbelow with reference to FIG. 5.

In case the EGR pipe 44 is formed of a material "SUS 304" which is classified in the Japanese Industrial Standard, the inner diameter D of the EGR pipe 44 may be 10 mm, the length l of the aperture 48 may be 23.7 mm, the width d of the aperture 48 may be 5 mm and the radius r of a circular arc of each end of the aperture 48 may be 2.5 mm.

Figure 6:
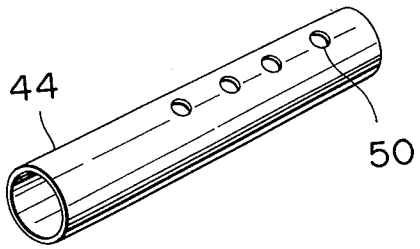
FIG. 6 is a perspective view of a modification of the EGR pipe to be used in the preferred embodiment of the present invention.
Figure 7:
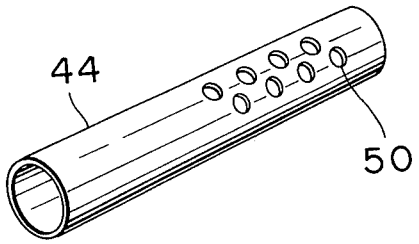
FIG. 7 is a perspective view of another modification of the EGR pipe to be used in the preferred embodiment of the present invention.

As shown in FIGS. 6 and 7, the EGR pipe 44 may be formed with a plurality of apertures 50 each having a circular cross-section, instead of the aperture 48. The apertures 50 may be arranged in a single line extending in the longitudinal direction of the EGR pipe 44 as in FIG. 6 or in two parallel lines each extending in the longitudinal direction of the EGR pipe 44 as in FIG. 7.

It is to be understood that the invention is not to be limited to the embodiment described in the foregoing, and that various changes and modifications may be made without departing from the spirit and scope of the invention as defined in the appended claims. For example, the present invention is not limited to the foregoing carburetor fuel system but also applicable to other systems such as a fuel injection system wherein the fuel is injected into the intake passage just upstream of an intake valve for each engine cylinder. Additionally, the EGR pipe 44 may have any shape as long as it passes the exhaust gases therethrough and the EGR passage 38 may be entirely defined by a single pipe. Furthermore, the apertures 50 may be arranged in lines of a reasonable number, being not limited to one or two lines and the cross-section of each aperture 50 is not limited to the circular shape but may be oval or other appropriate shape. Still further, the number of apertures 50 can be adjusted according to their shape and size.

What is claimed is:

1. In an internal combustion engine having a intake passage for passing therethrough intake flow of air or an air-fuel mixture toward engine cylinders and an exhaust passage for passing therethrough exhaust gases discharged from the engine cylinders, said intake passage having therein a throttle valve for controlling the intake flow passing therethrough, an exhaust gas recirculation system comprising:

a communicating passage means extending into the intake passage and providing communication between the exhaust passage and the intake passage downstream of the throttle valve for conducting a portion of the exhaust gases from the exhaust passage into the intake passage downstream of the throttle valve, said communicating passage means having a first section outside of the intake passage and a second section within the intake passage;

an elongated substantially straight member provided in the intake passage downstream of the throttle valve and having therein said second section which is substantially straight and extends in the longitudinal direction of said elongated member, said elongated member having a continuous and unobstructed outlet for the exhaust gases at its side downstream of the intake flow through the throttle valve, said outlet communicating said second section with the intake passage at a side of said elongated member downstream of the intake flow through the throttle valve for introducing the exhaust gases into the intake passage in a direction substantially along the direction of the intake flow through the throttle valve; and said elongated member arranged such that the exhaust gases are prevented from flowing upstream toward the throttle valve.

2. An exhaust gas recirculation system as set forth in claim 1 wherein said continuous outlet comprises an elongated aperture which extends in the longitudinal direction of said second section.

3. An exhaust gas recirculation system as set forth in claim 2 wherein said elongated member is placed substantially perpendicular to the intake flow through the throttle valve.

4. An exhaust gas recirculation system as set forth in claim 3 wherein said elongated member crosses the intake passage.

5. An exhaust gas recirculation system as set forth in claim 4 wherein said elongated member is of a cylindrical shape and said aperture is an elongated slot with arched ends.

6. An exhaust gas recirculation system as set forth in claim 5 wherein the inner diameter of said elongated member is 10 mm, the length of said aperture is 23.7 mm, the width of said aperture is 5 mm and the radius of each arched end is 2.5 mm.

7. In an internal combustion engine having an intake passage for passing therethrough intake flow of air or an air-fuel mixture toward engine cylinders and an exhaust passage for passing therethrough exhaust gases discharged from the engine cylinders, said intake passage having therein a throttle valve for controlling the intake flow passing therethrough, an exhaust gas recirculation system comprising:

a communicating passage means extending into the intake passage and providing communication between the exhaust passage and the intake passage downstream of the throttle valve for conducting a portion of the exhaust gases from the exhaust passage into the intake passage downstream of the throttle valve, said communicating passage means having a first section outside of the intake passage and a second section within the intake passage;

a member provided in the intake passage downstream of the throttle valve and having therein said second section, said member having means for communicating said second section with the intake passage at a side of said elongated member downstream of the intake flow through the throttle valve for introducing the exhaust gases into the intake passage in a direction substantially along the direction of the intake flow through the throttle valve, said member arranged such that the exhaust gases are prevented from flowing upstream toward the throttle valve; and said means for communicating so arranged as to substantially prevent deposition of the exhaust gas contaminants contained in the exhaust gases fed from said first section on a side of said second section downstream of the intake flow through the throttle valve.

8. An exhaust gas recirculation system as set forth in claim 7 wherein said communicating means is an opening formed in said member at said side thereof downstream of the intake flow through the throttle valve, said opening being sufficiently large to serve as an outlet for all the exhaust gases to be introduced from said second section into the intake passage.

9. In an internal combustion engine having an intake passage for passing therethrough intake flow of air or an air-fuel mixture toward engine cylinders and an exhaust passage for passing therethrough exhaust gases discharged from the engine cylinders, said intake passage having therein a throttle valve for controlling the intake flow passing therethrough, an exhaust gas recirculation system comprising:

a communicating passage means extending into the intake passage and providing communication between the exhaust passage and the intake passage downstream of the throttle valve for conducting a portion of the exhaust gases from the exhaust passage into the intake passage downstream of the throttle valve, said communicating passage means having a first section outside of the intake passage and a second section within the intake passage;

an elongated substantially straight member provided in the intake passage downstream of the throttle valve and having therein said second section which is substantially straight and extends in the longitudinal direction of said elongated member, said elongated member having an elongated aperture at a side thereof downstream of the intake flow through the throttle valve to provide communication between said second section and the intake passage at the downstream side of said elongated member for introducing the exhaust gases into the intake passage in a direction substantially along the direction of the intake flow through the throttle valve, said aperture extending in the longitudinal direction of said second section and being sufficiently long and wide to form a continuous and unobstructed outlet for the exhaust gases at the side of said elongated member downstream of the intake flow through the throttle valve; and said elongated member being arranged such that the exhaust gases are prevented from flowing upstream toward the throttle valve.

10. In an internal combustion engine having an intake passage for passing therethrough intake flow of air or an air-fuel mixture toward engine cylinders and an exhaust passage for passing therethrough exhaust gases discharged from the engine cylinders, said intake passage having therein a throttle valve for controlling the intake flow passing therethrough, an exhaust gas recirculation system comprising:

a communicating passage means extending into the intake passage and providing communication between the exhaust passage and the intake passage downstream of the throttle valve for conducting a portion of the exhaust gases from the exhaust passage into the intake passage downstream of the throttle valve, said communicating passage means having a first section outside of the intake passage and a second section within the intake passage;

said second section provided in the intake passage downstream of the throttle valve and being elongated and substantially straight, said second section having exposing means for exposing said second section to the intake passage at a side thereof downstream of the intake flow through the throttle valve substantially throughout the length of said second section and for introducing the exhaust gases into the intake passage in a direction substantially along the direction of the intake flow through the throttle valve; and said second section being arranged such that the exhaust gases are prevented from flowing upstream toward the throttle valve.

11. An exhaust gas recirculation system as set forth in claim 10 wherein said second section crosses the intake passage substantially perpendicularly to the intake flow through the throttle valve.

12. An exhaust gas recirculation system as set forth in claim 10 wherein said exposing means comprises an elongated aperture provided in said second section at its downstream side and extending substantially completely across said second section.

13. An exhaust gas recirculation system as set forth in claim 11 wherein said exposing means is an elongated aperture provided in said section at its downstream side and extending substantially completely across said second section.

14. In an internal combustion engine having an intake passage for passing therethrough intake flow of air or an air-fuel mixture toward engine cylinders and an exhaust passage for passing therethrough exhaust gases discharged from the engine cylinders, said intake passage having therein a throttle valve for controlling the intake flow passing therethrough, an exhaust gas recirculation system comprising:

a communicating passage means extending into the intake passage and providing communication between the exhaust passage and the intake passage downstream of the throttle valve for conducting a portion of the exhaust gases from the exhaust passage into the intake passage downstream of the throttle valve, said communicating passage means having a first section outside of the intake passage and a second section within the intake passage; and an elongated substantially straight member provided in the intake passage downstream of the throttle valve and having therein said second section which is substantially straight and having substantially the same length as said elongated member, said elongated member having an elongated aperture at a side thereof downstream of the intake flow through the throttle valve for communicating said second section with the intake passage at a side of said second section downstream of the intake flow through the throttle valve for introducing the exhaust gases into the intake passage in a direction substantailly along the direction of the intake flow through the throttle valve, said aperture having substantially the same length as said second section;

said elongated member arranged such that the exhaust gases are prevented from flowing upstream toward the throttle valve.

15. An exhaust gas recirculation system as set forth in claim 14, wherein said elongated member crosses the intake passage substantially perpendicularly to the intake flow through the throttle valve.

16. An exhaust gas recirculation system as set forth in claim 15 wherein said elongated member is of a cylindrical shape and said aperture is an elongated slot with arched ends.

17. An exhaust gas recirculation system as set forth in claim 16 wherein the inner diameter of said elongated member is 10 mm, the length of said aperture is 23.7 mm, the width of said aperture is 5 mm and the radius of each arched end is 2.5 mm.

* * * * *